US005360096A

United States Patent [19]

Lier et al.

[11] Patent Number: 5,360,096

[45] Date of Patent: * Nov. 1, 1994

[54] MAGNET RETENTION FOR SLUG REJECTION IN A COIN CHUTE ASSEMBLY

[75] Inventors: Pierre Lier, Wantagh; Arkady Zirkiev, Forest Hills, both of N.Y.

[73] Assignee: Greenwald Industries Inc., Brooklyn, N.Y.

[ * ] Notice: The portion of the term of this patent subsequent to Nov. 16, 2010 has been disclaimed.

[21] Appl. No.: 152,202

[22] Filed: Nov. 12, 1993

Related U.S. Application Data

[63] Continuation-in-part of Ser. No. 938,710, Sep. 1, 1992, Pat. No. 5,261,519.

[51] Int. Cl.[5] ..... G07D 5/08

[52] U.S. Cl. ..... 194/235; 194/325

[58] Field of Search ..... 194/235, 238, 320, 321, 194/325

[56] References Cited

U.S. PATENT DOCUMENTS

| | | | |
|---|---|---|---|
| 799,045 | 9/1905 | Grover | 194/320 X |
| 1,109,690 | 9/1914 | Merkle | 194/321 |
| 1,957,091 | 5/1934 | Block | 194/320 X |
| 2,026,921 | 1/1936 | Tratsch et al. | 194/320 X |
| 2,233,653 | 3/1941 | Tratsch | 194/320 |
| 3,602,352 | 8/1971 | Robinson | 194/238 |
| 3,978,960 | 9/1976 | Mellinger et al. | 194/235 |
| 4,221,285 | 9/1980 | Greenwald et al. | 194/238 |
| 4,502,584 | 3/1985 | Lambiris | 194/257 |
| 5,027,936 | 7/1991 | Boyett | 194/325 |
| 5,220,988 | 6/1993 | Wilfong et al. | 194/235 |
| 5,261,519 | 11/1993 | Zirkiev | 194/235 |

*Primary Examiner*—F. J. Bartuska

*Attorney, Agent, or Firm*—McAulay Fisher Nissen Goldberg & Kiel

[57] ABSTRACT

An improved mounting arrangement of a magnet within a coin chute assembly is disclosed which serves as a ferro-magnetic slug rejection system for a coin chute adapted to receive coins in a vertical position. The coin chute includes a coin slide disposed for movement inwardly of the assembly to an operate position. The magnet is mounted to a cover plate which is connected to a flange of the coin chute. The magnet is captured between the flange and projections on the cover plate thereby to be securely held in its mounted position. Alternatively, the magnet may be fitted within opposed notched edges of the cover plate in an interference fit relation. The magnet raises the slug carried by the coin slide so that inward movement of the slide causes the slug to abut against an abutment surface of the assembly thereby to prevent continued inward movement of the slide to its operate position.

9 Claims, 3 Drawing Sheets

MAGNET RETENTION FOR SLUG REJECTION IN A COIN CHUTE ASSEMBLY

CROSS REFERENCE TO RELATED APPLICATION

This application is a continuation-in-part of application Ser. No. 07/938,710 filed Sep. 1, 1992, which issued into U.S. Pat. No. 5,261,519 on Nov. 16, 1993.

BACKGROUND OF THE INVENTION

1. Field of the Invention

This invention relates to an improved mounting arrangement of a magnet within a coin chute assembly. The coin chute includes a coin slide adapted to receive coins in a vertical position and which is disposed for movement inwardly of the assembly to an operate position. The magnet raises a ferro-magnetic slug carried by the coin slide so that inward movement of the slide causes the slug to abut against an abutment surface of the assembly thereby to prevent continued inserted movement of the slide to its operate position.

2. Description of the Prior Art

Coin chute assemblies are usually installed on commercial appliances such as clothes washers, dryers, vending machines, and the like. The assembly typically is enclosed within a housing mounted on the appliance or machine. The assembly includes a coin chute having a coin slide reciprocally mounted in a guide track for inserted or inward movement of the assembly and retracted or outward movement thereof. The coin slide is formed having one or more coin receiving slots whereby the presence of an appropriately sized coin in the slot is operative to allow inward movement of the coin slide to an operate position thereof. The inner end of the coin slide is provided with an operator for actuating the appliance or machine upon continued movement of the slide inwardly to its operate position.

The housing of the assembly usually is provided with a locked coin drawer which prevents unauthorized access to a coin receptacle located below and in spaced relation to the coin slide. The arrangement is such that the coins necessary to operate the appliance or machine are carried by the coin slide upon inserted movement of the slide to its operate position whereupon the coins exit from the assembly through suitable openings thereby to be transmitted to the coin receptacle.

In the prior art, there are numerous types of coin chute assemblies which are operable by means of a plurality of coins carried by the coin slide either in a flat or horizontal position, or in an upstanding edge or vertical position. Two of such assemblies are exemplified by U.S. Pat. No. Re. 31,085 dated Nov. 23, 1983 in the name of Harry Greenwald et al., and U.S. Pat. No. 4,502,584 dated Mar. 5, 1985 in the name of Christos Lambiris.

In any coin handling mechanism, it is desirable to provide means to reject ferro-magnetic slugs which are used to operate the mechanism without the presence of proper coins. Such slug rejection systems typically include a magnet mounted within the housing and positioned to raise a slug carried by a coin slide out of its intended path of travel. Raising of the slug causes it to be carried against a stop or abutment surface within the housing or coin chute assembly to prevent further inward movement of the slide to its operate position.

The mounting of such a magnet in a coin chute assembly wherein the coin slide carries coins in a horizontal position has not presented a problem. There is suitable space and support within the housing to mount the magnet for it to perform its intended function. The magnet need not be too large nor its pulling force too strong since the influence of the magnet is over the flat and relatively large surface of the slug. In contrast, the use of a magnet in instances where the coin slide carries the coins in a vertical position ("vertical coin chutes") has proven quite troublesome. A much more powerful magnet is needed since the pulling or lifting force is confined to an edge of the slug. While there has been some success in the use of a magnet carried by vertical coin chutes, the placement of the magnet has proven tedious and unreliable, particularly in view of its required strength.

That is, it is known to manually position the magnet within the housing in a frictionally fitting or wedge-like engagement against a vertical face of the housing at a position above where the slug is carried by the coin slide. However, as a result of repeated operation of the slide which produces an impact on the housing, and the presence of other stationary ferro-magnetic material included as part of the coin chute mechanism which exerts a pull on the magnet, the magnet has a tendency to become dislodged from its mounted position so as to have little or no effect on a slug that may be carried by the slide.

It is also known, as shown in U.S. Pat. No. 5,027,936 dated Jul. 2, 1991 in the name of Timothy E. Boyett, to support a cylindrical magnet as a component of the coin rejection station of a coin chute assembly. The coin rejection station is spaced considerably inboard and out of engagement with the coin chute flange of the assembly. A cylindrical stop member also is mounted to the coin rejection station and is spaced inboard of the magnet. In operation, inward movement of the coin slide carries the slug to a position where it is lifted by the magnet out of the path of travel of the slide. Thereafter, continued inward movement of the slide causes the slug to bear against the cylindrical stop thereby to jam the mechanism and prevent continued inward movement of the slide to its operate position. The Boyet slug rejection system is not deemed reliable in operation and is not practical because of space limitations within the housing.

U.S. Pat. No. 5,261,519 dated Nov. 16, 1993 in the name of Arkady Zirkiev, and commonly owned by the same assignee of this application, discloses a coin chute assembly wherein the coin chute flange is formed with a recessed portion in its inner surface. A magnet is mounted to a cover plate which is received and secured within the recessed portion of the flange. Specifically, the cover plate is provided with opposed notched edges which receive the opposed end edges of the magnet for holding the magnet in place. The arrangement is such that the magnet is located inboard of the outer surface of the coin chute flange and positioned above the coin slot openings of the flange. In operation, inward movement of the coin slide places an edge of a ferro-magnetic slug carried by the slide under the magnet causing the slug to be lifted or raised against the magnet. The slug is now positioned such that continued inward movement of the slide causes the raised slug to abut against an abutment surface of the assembly to prevent further inward movement of the slide to its operate position.

While the ferro-magnetic slug rejection system of Zirkiev performs its intended function, it has been learned that the magnet may have a tendency to become disengaged from the notched edges of the cover plate upon repeated cycling of the coin slide. Also, the magnetic attraction of the magnet with ferro-magnetic components of the coin chute assembly contributes to the tendency of the magnet from becoming disengaged.

It is known that an adhesive can be used to cement the magnet in place. However, use of an adhesive is time consuming, messy, creates undesirable fumes in the assembly process, and makes it difficult to remove or replace the magnet should that later become necessary.

The present invention is directed toward an improved mounting arrangement for the magnet in a vertical coin chute disclosed in Zirkiev which is easy to install and reliable in operation.

SUMMARY OF THE INVENTION

The coin chute assembly herein corresponds to that disclosed in Zirkiev and is incorporated herein by reference. The improved mounting arrangement for the magnet herein provides for a plurality of projections on the inner surface of the cover plate. Preferably, one of such projections is positioned adjacent each one of the opposed notched edges of the cover plate. In assembly, the magnet is captured between the cover plate and the coin chute flange with the inner surface of the magnet abutting the projections thereby to securely hold the magnet in its mounted position.

In another embodiment of the invention, the opposed side edges of the cover plate are crimped to provide an interference fit between the opposed notched edges of the plate and the opposed end edges of the magnet for securely holding the magnet in place.

For a more complete appreciation of the invention, and its various features and advantages, reference should be made to the following detailed description when taken in conjunction with the following drawings:

DESCRIPTION OF THE PREFERRED EMBODIMENT

Figure 1:
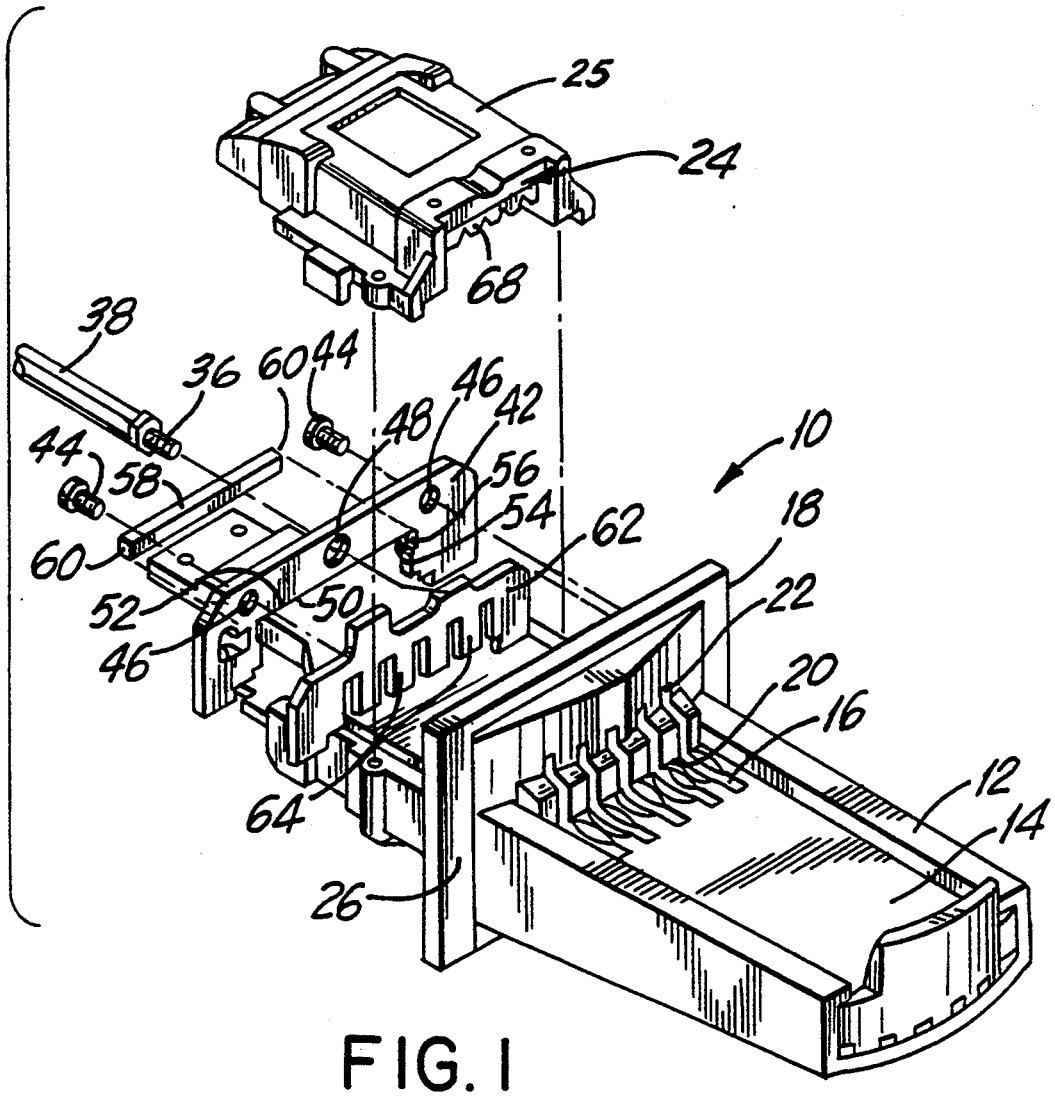
FIG. 1 is an exploded perspective view of the associated elements of the coin chute assembly.

Referring to the drawings, and particularly to FIG. 1, there is shown a coin chute assembly represented generally by numeral 10. Assembly 10 includes a guide track 12 reciprocally supporting a coin slide 14 for inserted or inward movement of the assembly and retracted or outward movement thereof. Coin slide 14 is formed having a plurality of coin support slots 16 each adapted to hold a coin placed therein in a vertical plane.

Coin chute assembly 10 also includes a vertical flange 18 formed having a substantially centrally located opening 20 through which passes the coin carrying portion of coin slide 14. Flange 18 further is formed having a plurality of open ended slots 22 disposed vertically and in parallel relation to one another. The open ends of slots 22 communicate with central opening 20 to permit passage of the coins carried by coin slide 14 in a vertical or standing-on-edge position upon inward movement of the coin slide, whereby the coins pass through flange 18 and are carried to a coin sizing mechanism represented generally by numeral 24, which is mounted to a top housing 25 of the assembly as hereinafter described.

Figure 2:
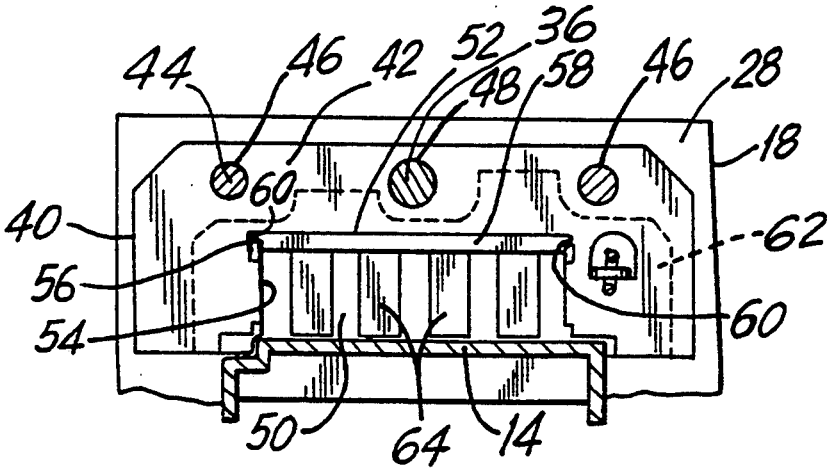
FIG. 2 is a partial elevational view of the inner surface of the coin chute flange showing the cover plate which carries the magnet mounted within the recessed portion of the flange, and representing the improved mounting arrangement of the magnet embodying the present invention.
Figure 3:
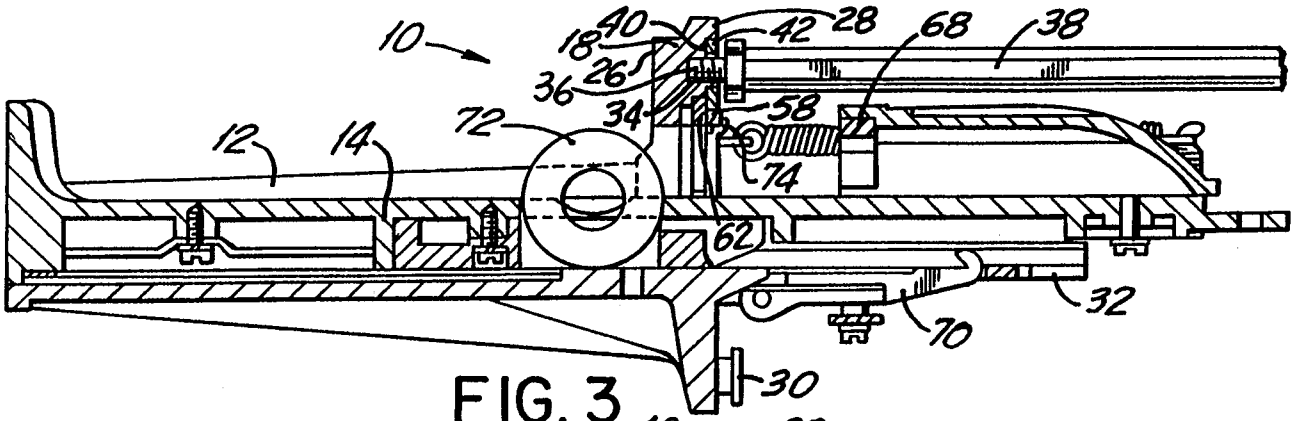
FIG. 3 is a longitudinal sectional view of the coin chute assembly as it would appear mounted to the front vertical face of a coin meter housing by a mounting bolt, the housing being removed for purpose of clarity, and showing the coin slide in its retracted coin receiving position having a ferro-magnetic slug positioned in the slide in a vertical or standing-on-edge position.
Figure 4:
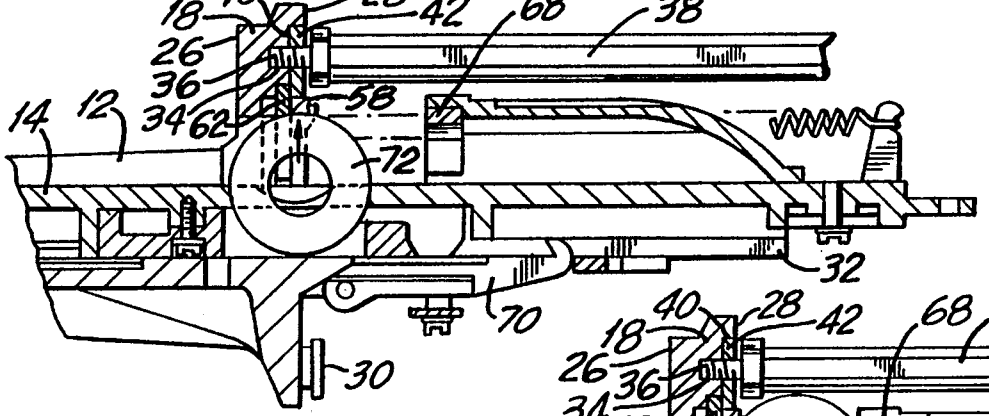
FIG. 4 is a partial sectional view similar to FIG. 3 with the coin slide advanced inwardly in the direction of its operate position, and with the slug raised out of its path of travel in contact with the magnet.

Coin chute flange 18 has an outer surface 26 and an inner surface 28 as shown in FIGS. 1 and 2. The inner surface 28 of flange 18 is formed having a plurality of projecting lugs 30, only one of which is shown in FIGS. 3 and 4, which serve to mount coin chute assembly 10 to a coin meter housing, not shown. The lugs 30 are positioned and configured so that a pair of such laterally spaced lugs are received in suitably provided openings in a face of the coin meter housing thereby to facilitate mounting of the coin chute assembly to the coin meter housing in a manner well known in the art. The arrangement is such that when coin chute assembly 10 is mounted to the coin meter housing, the inner end portion 32 of guide track 12 passes through an opening in the front face of the housing.

The inner surface 28 of coin chute flange 18 further includes a threaded opening 34 disposed centrally adjacent the upper edge of the flange. When coin chute assembly 10 is mounted to the coin meter housing, the threaded opening 34 is located in alignment with an opening in the front face of the housing for receiving the threaded end 36 of a mounting bolt 38 as shown in FIGS. 3–6.

The inner surface 28 of flange 18 is further formed having a recessed portion 40 into which is removably mounted a cover plate 42 by means of bolt fasteners 44. For this purpose, a pair of laterally spaced openings 46 are provided in plate 42 to permit passage of the shank portions of bolt fasteners 44 therethrough. Threaded openings are suitably provided in the inner surface 28 of flange 18 for threadedly engaging with bolt fasteners 44 to maintain plate 42 in place. A central opening 48 also is provided in plate 42, between the spaced openings 46, to permit passage of the threaded end 36 of bolt 38 therethrough.

As shown in FIGS. 1 and 2, cover plate 42 also is provided with a cut-out portion 50 defined by an upper edge 52 and opposed side edges 54. Cut-out portion 50 is configured to permit passage of coins therethrough upon inward movement of coin slide 14. The juncture where the upper edge 52 meets with the side edges 54 of cut-out portion 50 defines opposed notched edges 56.

A magnet 58 is provided, in the shape of an elongated bar of rectangular cross-section, having opposed end edges 60 which are fitted or received within the notched edges 56 of plate 42 so as to be carried by the plate and securely held in place. For this purpose, magnet 58 is dimensioned having a length slightly less than the length of the cut-out portion 50 of plate 42, as measured between the opposed notched edges 56, and a width approximately the same as the width of the upper edge 52 of cut-out portion 50. In the preferred embodiment, the length of magnet 58 is approximately 1.750 inches (4.445 cm) having a cross-section dimension of 0.080 inches by 0.100 inches (0.203 cm×0.254 cm). The arrangement is such that the magnet is inboard of outer surface 26 of flange 18 and positioned above the coin slot openings 22 of the flange.

If desired, a gate member 62 may be provided suitably dimensioned to also fit within the recessed portion 40 of flange 18 between the inner surface of the flange and the outer surface of cover plate 42. Gate 62 is disposed for sliding movement laterally of or transverse to coin slide 14 to close or block-off access to the coins in the slide inboard of flange 18. That is, gate 62 has finger elements 64 which initially are in a non-blocking position to permit passage of coins through the spaces separating the fingers. However, upon inward movement of coin slide 14, gate 62 is displaced cross-wise to locate the finger elements 64 in a blocking position to block-off the coin openings 22 in flange 18 to prevent retrieval of the coins after the slide has been inserted to its operate position. The use and operation of a gate member for this purpose is well known in the art and is not part of the present invention. The gate is referred to herein merely to show its position relative to the flange 18 and the cover plate 42.

Figure 5:
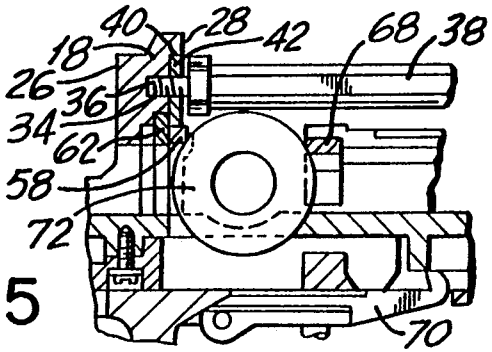
FIG. 5 is a partial sectional view similar to FIG. 4 with the coin slide advanced further inwardly to carry the raised slug in engagement with an abutment surface of the assembly to prevent further inward movement of the slide to its operate position.
Figure 6:
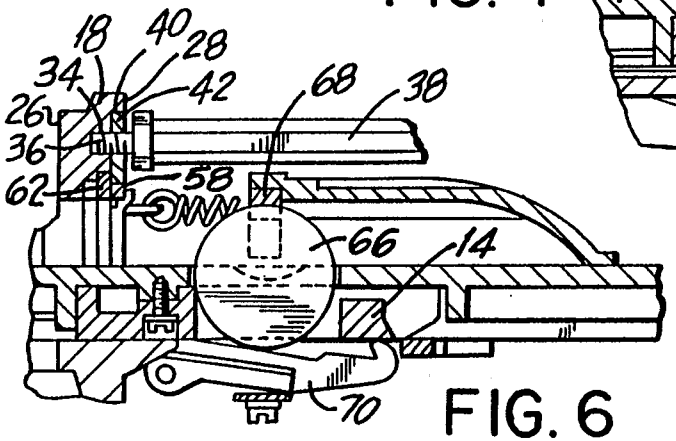
FIG. 6 is a partial sectional view similar to FIG. 4 with the coin slide carrying a proper coin in place of the slug past a coin sizing block and over a displaced blocking dog to permit continued inward movement of the slide to its operate position.

The operation of the slug rejection system can best be appreciated from a description of FIGS. 3–6. FIG. 6 illustrates a situation where coin slide 14 is carrying a proper coin 66 past the coin chute flange 18. Magnet 58 exerts no force on the coin which then is carried to a sizing block 68 of the coin sizing mechanism 24. The presence of a proper coin 66 serves to displace a blocking dog 70 downwardly out of the path of travel of coin slide 14, in a manner well known in the art, to permit continued inward movement of the coin slide to its operate position.

FIGS. 3–5 illustrate operation of the mechanism when coin 66 is replaced with a ferro-magnetic slug 72. In this instance, after the slug 72 is carried past the coin chute flange 18 as shown in FIG. 4, magnet 58 exerts a force to raise the slug out of its path of travel, in the direction of the arrow, and in contact with the magnet. However, the lower portion of slug 72 is still acted upon by movement of coin slide 14. Thus, continued inward movement of coin slide 14 with the slug 72 in the raised position causes the slug to bear against the sizing block 68. Since the raised slug cannot pass through the sizing block, the block serves as an abutment surface. Coin slide 14 is now prevented from further inward movement to its operate position. The arrangement and configuration of the parts is such that whereas coin slide 14 can no longer be inserted inwardly of the assembly, the operator can still retract the coin slide outwardly of the assembly carrying with it slug 72. This eliminates jamming of the slug within the assembly which would require servicing of the coin chute assembly by trained personnel.

Figure 7:
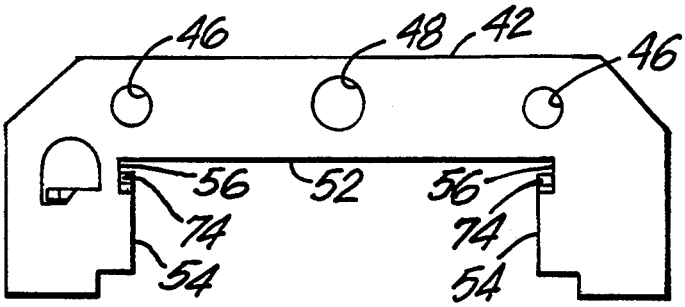
FIG. 7 is a front elevational view of the cover plate showing the outer surface thereof, and further showing the opposed notched edges configured to receive the opposed end edges of the magnet.
Figure 8:
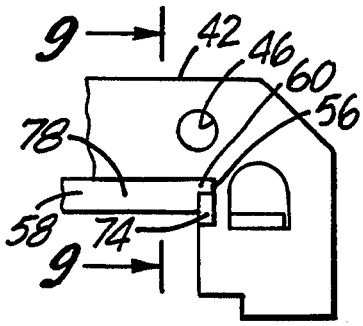
FIG. 8 is a partial view similar to FIG. 7 showing the inner surface of the cover plate with the magnet mounted in place, and with an end edge of the magnet abutting a projection of the cover plate adjacent one of the notched edges.
Figure 9:
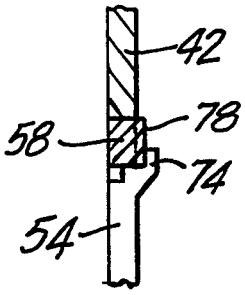
FIG. 9 is a sectional view taken along line 9—9 of FIG. 8.

In accordance with the invention, there is disclosed an improved mounting arrangement of magnet 58 to cover plate 42. Specifically, with reference to FIGS. 7–9, cover plate 42 is formed with projections 74 on the inner surface 76 of the plate. The projections are formed by a stamping operation during manufacture of the plate. The configuration is such that one projection 74 is located adjacent each one of the opposed notched edges 56 of the plate. Projections 74 extend in a blocking position relative to magnet 58. That is, the opposed end edges 60 of magnet 58 are fitted within the opposed notched edges 56 of cover plate 42 from the outer surface 76 of said plate. Full insertion of magnet 58 within the opposed notched edges 56 of cover plate 42 causes inner surface portions 78 of the magnet to abut against projections 74. The magnet 58 is thus captured between projections 74 of cover plate 42 and the inner surface of coin chute flange 18, or the inner surface of gate 62 as the case may be, thereby to securely hold magnet 58 in its mounted position.

Figure 10:
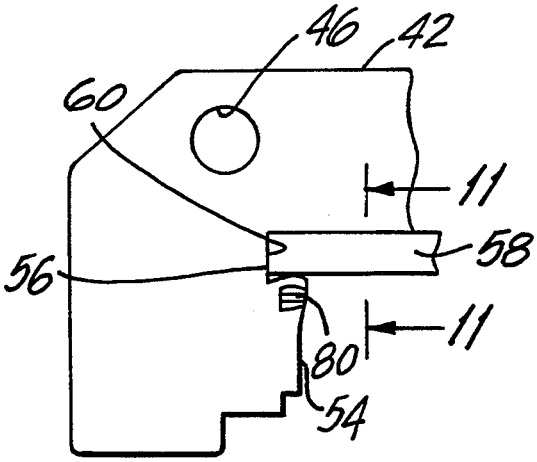
FIG. 10 is a partial elevational view of a different cover plate showing another embodiment of the invention wherein a side edge of the plate is crimped to provide an interference fit between the notched edge of the plate and the end edge of the magnet.
Figure 11:
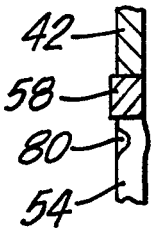
FIG. 11 is a sectional view taken along line 11—11 of FIG. 10.

FIGS. 10–11 show another embodiment of the invention wherein, in place of projections 74, the opposed side edges 54 of cover plate 42 are crimped, as represented by numeral 80, to provide an interference fit between the opposed notched edges 56 of cover plate 42 and the opposed end edges 60 of magnet 58 for securely holding magnet 58 in place. As will be appreciated, the crimping is effected by a stamping operation after the magnet is first fitted within the opposed notched edges of the plate.

There are thus described novel mounting arrangements of the magnet to the cover plate, which magnet is easily securely positioned in place for reliable operation.

While the present invention has been described with respect to particular embodiments, it will be readily appreciated and understood that numerous variations and modifications thereof may be made without departing from the spirit or scope of the claimed invention.

We claim:

1. In a coin chute assembly having a top housing containing a coin sizing mechanism, said coin sizing mechanism having an outer surface and an inner surface, said assembly further having a substantially vertical flange formed with coin slot openings to permit the passage of coins therethrough, said coin chute flange having an outer surface and an inner surface, said assembly further having a coin slide disposed for reciprocal movement for carrying vertically oriented coins positioned in said slide outboard of the outer surface of said coin chute flange through the coin slot openings of said flange, the presence of proper coins permitting said coin slide to be moved inwardly of said assembly for carrying the coins past the inner surface of said coin sizing mechanism and permit continued inward movement of said coin slide to an operate position, and an abutment surface positioned within said assembly, the presence of a ferro-magnetic slug carried by said coin slide being detected by said assembly and carried into engagement with said abutment surface to restrict continued inward movement of said coin slide, wherein the improvement comprises:

said abutment surface being located inboard of said coin chute flange by an amount which is no greater than the distance between the inner surface of said flange and the outer surface of said coin sizing mechanism;

a magnet located inboard of the outer surface of said coin chute flange and outboard of said top housing, said magnet having an outer surface, an inner surface, and opposed end edges;

a substantially vertical cover plate having an outer surface and an inner surface, the outer surface of said plate being mounted to the inner surface of said coin chute flange;

said magnet being mounted to said cover plate and positioned above a zone of the coin slot openings of said coin chute flange through which the coins pass, inward movement of said coin slide causing any coins carried by said slide to pass under said magnet;

inward movement of said coin slide placing an edge of a ferro-magnetic slug carried by said slide under said magnet causing the slug to be raised up against said magnet; and continued inward movement of said coin slide with the raised slug causing the slug to abut against said abutment surface to restrict entry of the slug into said housing and prevent passage thereof through said coin sizing mechanism to thereby prevent further movement of said coin slide to its operate position inwardly of said assembly.

2. The coin chute assembly of claim 1, further comprising at least one projection on the inner surface of said cover plate, the inner surface of said magnet abutting said projection when said magnet is mounted to said cover plate.

3. The coin chute assembly of claim 1, further comprising notch means in said cover plate, said notch means having opposed notched edges providing an interference fit relation between the opposed end edges of said magnet and said opposed notched edges for securely holding said magnet in place.

4. The coin chute assembly of claim 1, wherein the inner surface of said coin chute flange has a recessed portion, said cover plate being configured to be received in the recessed portion of said flange.

5. The coin chute assembly of claim 1, wherein said magnet is positioned above and extends across the zone of all the coin slot openings of said coin chute flange through which the coins pass.

6. In a coin chute assembly having a substantially vertical flange formed with coin slot openings to permit the passage of coins therethrough, said coin chute flange having an outer surface and an inner surface, said assembly further having a coin slide disposed for reciprocal movement for carrying vertically oriented coins positioned in said slide outboard of the outer surface of said coin chute flange through the coin slot openings of said flange, the presence of proper coins permitting said coin slide to be moved inwardly of said assembly to an operate position, and said assembly further having an internal abutment surface, the presence of a ferro-magnetic slug carried by said coin slide being detected by said assembly and carried into engagement with said abutment surface to restrict continued inward movement of said coin slide, wherein the improvement comprises:

a magnet located inboard of the outer surface of said coin chute flange and positioned above the coin slot openings of said flange, said magnet having an outer surface, an inner surface, and opposed end edges;

the inner surface of said coin chute flange having a recessed portion;

a substantially vertical cover plate having an outer surface and an inner surface, said cover plate being configured to be received in the recessed portion of said coin chute flange with the outer surface of said cover plate mounted to the inner surface of said coin chute flange;

said cover plate having a cut-out portion defined by an upper edge and opposed side edges, the juncture where the upper edge meets with the side edges of said cut-out portion defining opposed notched edges;

the opposed end edges of said magnet being fitted within the opposed notched edges of said cut-out portion so as to be carried by said cover plate;

a projection on each one of the side edges of said cut-out portion positioned adjacent each one of said opposed notched edges;

the inner surface of said magnet abutting said projections when said magnet is mounted to said cover plate; and fastener means for removably mounting said cover plate within the recessed portion of said coin chute flange;

inward movement of said coin slide placing an edge of a ferro-magnetic slug carried by said slide under said magnet causing the slug to be raised up against said magnet;

whereby continued inward movement of said coin slide causes the raised slug to abut against said abutment surface to prevent further movement of said coin slide to its operate position inwardly of said assembly.

7. In a coin chute assembly having a substantially vertical flange formed with coin slot openings to permit the passage of coins therethrough, said coin chute flange having an outer surface and an inner surface, said assembly further having a coin slide disposed for reciprocal movement for carrying vertically oriented coins positioned in said slide outboard of the outer surface of said coin chute flange through the coin slot openings of said flange, the presence of proper coins permitting said coin slide to be moved inwardly of said assembly to an operate position, and said assembly further having an abutment surface, the presence of a ferro-magnetic slug carried by said coin slide being detected by said assembly and carried into engagement with said abutment surface to restrict continued inward movement of said coin slide, wherein the improvement comprises:

a magnet located inboard of the outer surface of said coin chute flange and positioned above the coin slot openings of said flange, said magnet having an outer surface, an inner surface, and opposed end edges;

a substantially vertical cover plate having an outer surface and an inner surface, the outer surface of said plate being mounted to the inner surface of said coin chute flange;

said cover plate having opposed notched edges for receiving the opposed end edges of said magnet;

said cover plate further having a plurality of projections on the inner surface thereof, at least one of said projections positioned adjacent each one of said opposed notched edges; and said magnet being mounted to said cover plate with the inner surface of said magnet abutting said projections;

inward movement of said coin slide placing an edge of a ferro-magnetic slug carried by said slide under said magnet causing the slug to be raised up against said magnet;

whereby continued inward movement of said coin slide causes the raised slug to abut against said abutment surface to prevent further movement of said coin slide to its operate position inwardly of said assembly.

8. In a coin chute assembly having a substantially vertical flange formed with coin slot openings to permit the passage of coins therethrough, said coin chute flange having an outer surface and an inner surface, said assembly further having a coin slide disposed for reciprocal movement for carrying vertically oriented coins positioned in said slide outboard of the outer surface of said coin chute flange through the coin slot openings of said flange, the presence of proper coins permitting said coin slide to be moved inwardly of said assembly to an operate position, and said assembly further having an abutment surface, the presence of a ferro-magnetic slug carried by said coin slide being detected by said assembly and carried into engagement with said abutment surface to restrict continued inward movement of said coin slide, wherein the improvement comprises:

a magnet located inboard of the outer surface of said coin chute flange and positioned above the coin slot openings of said flange, said magnet having an outer surface, an inner surface, and opposed end edges;

a substantially vertical cover plate having an outer surface and an inner surface, the outer surface of said plate being mounted to the inner surface of said coin chute flange;

said cover plate having a cut-out portion defined by an upper edge and opposed side edges, the juncture where the upper edge meets with the side edges of said cut-out portion defining opposed notched edges;

the opposed end edges of said magnet being fitted within the opposed notched edges of said cut-out portion so as to be mounted to said cover plate; and a projection on each one of the side edges of said cut-out portion positioned adjacent each one of said opposed notched edges, the inner surface of said magnet abutting said projections;

inward movement of said coin slide placing an edge of a ferro-magnetic slug carried by said slide under said magnet causing the slug to be raised up against said magnet;

whereby continued inward movement of said coin side causes the raised slug to abut against said abutment surface to prevent further movement of said coin slide to its operate position inwardly of said assembly.

9. In a coin chute assembly having a substantially vertical flange formed with coin slot openings to permit the passage of coins therethrough, said coin chute flange having an outer surface and an inner surface, said assembly further having a coin slide disposed for reciprocal movement for carrying vertically oriented coins positioned in said slide outboard of the outer surface of said coin chute flange through the coin slot openings of said flange, the presence of proper coins permitting said coin slide to be moved inwardly of said assembly to an operate position, and said assembly further having an abutment surface, the presence of a ferro-magnetic slug carried by said coin slide being detected by said assembly and carried into engagement with said abutment surface to restrict continued inward movement of said coin slide, wherein the improvement comprises:

a magnet located inboard of the outer surface of said coin chute flange and positioned above the coin slot openings of said flange, said magnet having an outer surface, an inner surface, and opposed end edges;

a substantially vertical cover plate having an outer surface and an inner surface, the outer surface of said plate being mounted to the inner surface of said coin chute flange;

said cover plate having a cut-out portion defined by an upper edge and opposed side edges, the juncture where the upper edge meets with the side edges of said cut-out portion defining opposed notched edges;

the opposed end edges of said magnet being fitted within the opposed notched edges of said cut-out portion so as to be mounted to said cover plate; and the side edges of said cut-out portion adjacent said notched edges being crimped to provide an interference fit relation between the opposed end edges of said magnet and said opposed notched edges for securely holding said magnet in place;

inward movement of said coin slide placing an edge of a ferro-magnetic slug carried by said slide under said magnet causing the slug to be raised up against said magnet;

whereby continued inward movement of said coin slide causes the raised slug to abut against said abutment surface to prevent further movement of said coin slide to its operate position inwardly of said assembly.

* * * * *